US005154343A

United States Patent [19]

Stone

[11] Patent Number: 5,154,343

[45] Date of Patent: Oct. 13, 1992

[54] FLIP-TOP RECLOSEABLE CARTON WITH POSITIVE CLOSURE ARRANGEMENT

[75] Inventor: James L. Stone, Grand Rapids, Mich.

[73] Assignee: Packaging Corporation of America, Evanston, Ill.

[21] Appl. No.: 822,994

[22] Filed: Jan. 21, 1992

[51] Int. Cl.[5] ..... B65D 5/54

[52] U.S. Cl. ..... 229/225; 229/224; 229/160.1

[58] Field of Search ..... 229/224, 225, 226, 160.1; 206/268, 273

[56] References Cited

U.S. PATENT DOCUMENTS

| | | | |
|---|---|---|---|
| 2,396,310 | 3/1946 | Yungblut | 229/225 |
| 2,881,967 | 4/1959 | Ringler | 229/160.1 |
| 3,432,090 | 3/1969 | Engel | 229/225 |
| 3,910,486 | 10/1975 | Stone | 229/225 |
| 4,048,052 | 9/1977 | Tolaas | 229/224 |
| 4,083,455 | 4/1978 | Keating, Jr. | 229/226 |
| 4,289,239 | 9/1981 | Meyers | 229/226 |
| 4,948,038 | 8/1990 | Moeller | 206/223 |
| 4,986,420 | 1/1991 | Gunn et al. | 229/225 |
| 5,092,516 | 3/1992 | Kastanek | 229/226 |

*Primary Examiner*—Gary E. Elkins
*Attorney, Agent, or Firm*—Arnold, White & Durkee

[57] ABSTRACT

An improved flip-top recloseable carton is provided in the form of a six-sided parallelopiped enclosure having opposing top and bottom walls, front and back walls, and side walls formed from corresponding panels and flaps defined on a unitary, continuous paperboard blank. The outer layers of the side walls and the front wall are provided with horizontal tear-strip sections which define an integral and continuous tear strip that functions as convenient means for opening the carton from its sealed from. Repeated closing and positive locking of the carton is realized by means of a die-cut portion on the interior surface of the front wall which includes a proximal flap and an island portion dispersed in forcibly displaceable mutual engagement. Once the engaging flap and island are disengaged forcibly by opening the carton top, reclosing thereof leads to snap re-engagement of the flap and island elements accompanied by positive tactile and audible feedback indicative of effective carton closure.

5 Claims, 2 Drawing Sheets

FLIP-TOP RECLOSEABLE CARTON WITH POSITIVE CLOSURE ARRANGEMENT

BACKGROUND OF THE INVENTION

1. Field of the Invention

The present invention relates generally to cardboard cartons or like containers. More specifically, the present invention relates to recloseable cardboard cartons which are particularly adapted to storing powdered or granular materials.

2. Description of the Prior Art

In a variety of consumer packaging applications, it is important to have cardboard containers, cartons or the like which are capable of conveniently, yet securely being opened and reclosed repeatedly. The ability to be repeatedly opened and closed down in a lockable manner is particularly important where the container or carton is used for storage of granular or powdered material, such as laundry detergent powder. Various approaches have been undertaken to address the repeated opening and closing/locking requirements by means of carton designs using different types of inter-locking flaps.

One exemplary recloseable carton design, for instance, is the provision of a locking flap which is attached to the front wall of the carton and designed to engage with the inner layer of the frontal skirt panel in order that repeated closing/locking of the carton may be accomplished. A relatively common recloseable carton design merely involves the use of a friction fit between the frontal skirt panel of the container and the corresponding frontal section of a lid which is hingedly attached to the base of the carton.

In such boxed packages or containers, an integral tear strip is generally used as means by which a user may strip open a container which has been packed with the appropriate material and subsequently sealed. Once the carton top or lid has been separated from the base section by delineating the tear strip, the carton is opened by simply lifting the lid up. Subsequently, the carton is reclosed by simply pushing the lid back down to its original position; locking is realized by the friction fit between the lid and the corresponding engaging portion of the carton base—the blank used to form such a recloseable carton is, of course, dimensioned to ensure the requisite frictional engagement between the lid and the carton.

Conventional recloseable cartons of the above-identified type suffer from disadvantages which severely restrict their use in certain consumer packaging applications, particularly where the packaged product constitutes granular or powdered material such as concentrated laundry detergent powder or the like. A major drawback in this regard is the general absence of a positive locking arrangement in combination with a carton design which is conducive to repeated open and reclose operations. More specifically, the friction-fit designs have been found to be unacceptable from a consumer standpoint because of the distinct possibility of the lid opening by itself and leading to spillage of the contents thereof when such a closed carton is tipped over or otherwise disposed at an acute angle.

Another drawback with such recloseable carton designs is the absence of some form of positive indication, either tactile or audible, of the fact that an opened carton has been reclosed adequately in order to realize an effective locking position. It has been determined in this regard that the presence of such tactile or audible feedback indicative of effective locking is desirable because the presence thereof provides consumers with a high "comfort" factor with respect to reclosure. Particularly in applications where the recloseable cartons are used to house granulated material having a restricted storage life once the storage container has been torn open, such positive feedback has been determined to provide an apparent sense of reassurance to consumers as to retention of "freshness" or "safety" of the contained product.

There, accordingly, exists a distinct need for a recloseable, flip-top carton design which overcomes disadvantages of the above type associated with conventional recloseable cardboard cartons. The present invention effectively and conveniently realizes such an improved recloseable carton design.

SUMMARY OF THE INVENTION

In accordance with the foregoing, it is an objective of the present invention to provide a cardboard carton of the flip-top type which is repeatedly recloseable by means of a positive locking arrangement.

A related object of the present invention is to provide an improved recloseable carton of the above type which includes a positive locking arrangement adapted to provide positive tactile and/or audible feedback indicative of effective closure.

Yet another object of the present invention is to provide a recloseable carton which is particularly adapted to contain granular or powdered material in the form of an enclosure which is easily assembled and conveniently opened and reclosed for effective dispensing of material contained therein.

A further object of this invention is to provide such a recloseable carton which is adapted to efficient and cost-effective manufacture.

The above and other objects are realized, in accordance with the system of this invention, by providing a recloseable carton having a positive locking arrangement, with the carton being adapted for effective containment of granular material and the locking arrangement providing positive feedback indicative of effective reclosure, as will be described in detail below in conjunction with the accompanying drawings. The recloseable carton according to the present invention is in the form of a six-sided parallelopiped enclosure having opposing top and bottom walls, front and back walls, and side walls formed from corresponding panels and flaps defined on a unitary, continuous paperboard blank. The outer layers of the side walls and the front wall are provided with horizontal tear-strip sections which define an integral and continuous tear strip that functions as convenient means for opening the carton from its sealed from.

Repeated closing and positive locking of the carton is realized by means of a cut-out portion on the interior surface of the front wall which includes a proximal flap and an island portion dispersed in forcibly displaceable mutual engagement. Once the engaging flap and island are disengaged forcibly by opening the carton top, reclosing thereof leads to snap re-engagement of the flap and island elements accompanied by positive tactile and audible feedback indicative of effective carton closure.

Figure 1:
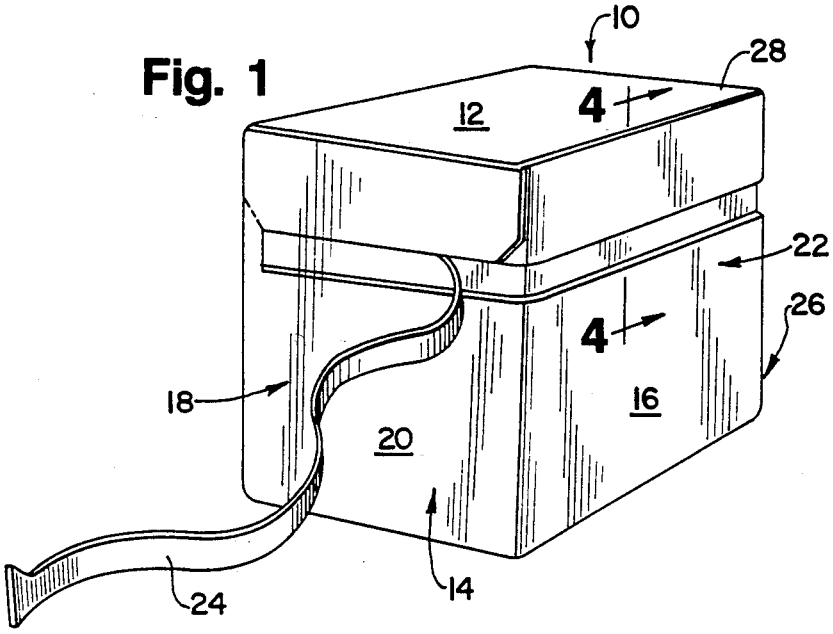
FIG. 1 is a perspective view of a recloseable cardboard carton in accordance with a preferred embodiment of the present invention, the carton being in its closed form with the tear strip partially pulled open.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Referring now to the drawings and in particular to FIG. 1, there is shown a perspective view of an exemplary flip-top, recloseable cardboard carton having a positive locking arrangement in accordance with an illustrative embodiment of the present invention. In particular, FIG. 1 shows a recloseable carton which is a six-sided parallelepiped enclosure formed of three pairs of opposing, generally rectangular walls or panels. More specifically, the carton 10 includes opposing top and bottom walls 12 and 14, respectively, opposing front and back walls 16 and 18, respectively, and opposing side walls 20 and 22, respectively.

The outer layers of the side walls 20, 22 and the front wall 16 and, more specifically, the relative upper portions thereof, are provided with horizontal tear strip sections which effectively define an integral and continuous tear strip 24. The tear strip 24 is fairly conventional and defined about the top panel of the blank used to form the recloseable carton 10, as will be described in detail below with reference to FIG. 2.

The tear strip 24 effectively functions as means for convenient opening of the carton 10 once it has been filled with the requisite contents and sealed. Tearing or pulling away of the tear strip 24 as indicated in FIG. 1 effectively releases the sealed edges of the side walls 20, 22 and the front wall 16 in order to delineate carton 10 into a bottom base portion generally indicated as 26 and a upper lid or top portion generally indicated as 28. The arrangement is such that, once the tear strip 24 has been completely pulled away, the carton top or lid can be swung or raised upwardly away from the carton base 26 by virtue of a hinged attachment of the horizontal edge of the top wall 12 to the corresponding horizontal edge of the back wall 18 of the carton 10.

Figure 2:
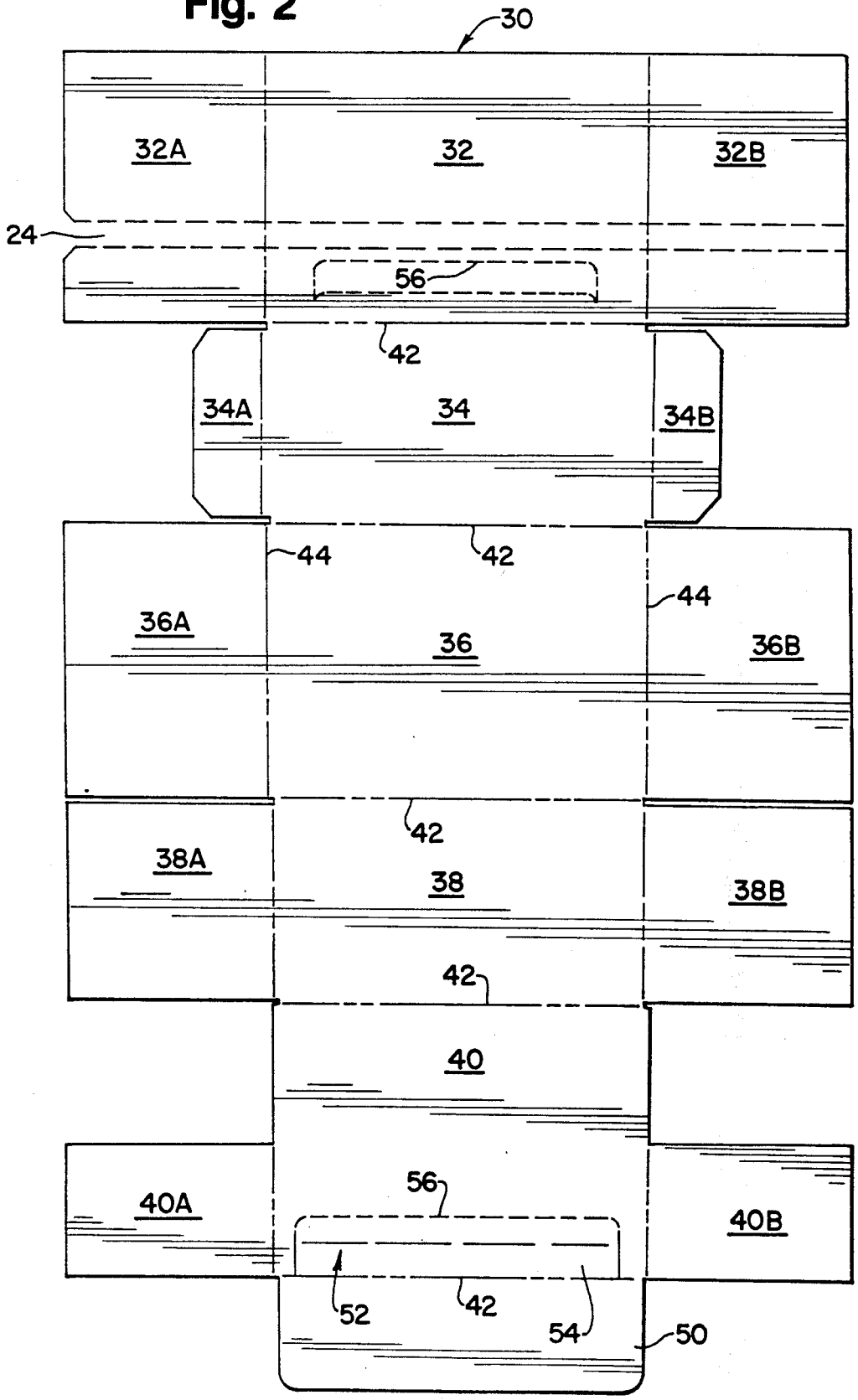
FIG. 2 is a top plan view of the cardboard blank used to form the recloseable carton shown at FIG. 1, according to an illustrative embodiment of this invention.

Referring now in particular to FIG. 2, there is illustrated a plan view of a cardboard blank used for forming a recloseable flip-top container box of the type described above in connection with FIG. 1. As shown in FIG. 2, the blank 30 is in the form of a single, planar, unitary section of cardboard or paper board which includes five vertically aligned, substantially rectangular panels 32, 34, 36, 38 and 40 which are linked to each other by means of horizontal score lines 42 which facilitate folding of the carton panels relative to each other. With respect to the manner in which these panels interact to define the closed carton shown in FIG. 1, the panel 32 functions as a front outer panel, the panel 34 functions as a top panel, the panel 36 functions as a back panel, the panel 38 functions as a bottom panel, and the panel 40 functions as a front inner panel.

Each of the five main panels comprising the carton blank 30 is provided with a pair of flaps connected along respective transverse edges by means of corresponding score lines. More specifically, the front outer panel 32 includes a left end flap 32A and a right end flap 32B. Similarly, left end and right end flaps 34A, 34B are respectively associated with the top panel 34, left and right end flaps 36A, 36B are respectively associated with the back panel 36, left and right end flaps 38A, 38B are associated with the bottom panel 38, and left and right end flaps 40A, 40B are associated with the front inner panel 40.

In the illustrative embodiment of FIG. 2, the end flaps 32A-B, 36A-B, 38A-B, and 40A-B have substantially the same transverse dimensions. However, the end flaps 34A-B corresponding to the top panel 34 have transverse dimensions which are substantially smaller than the corresponding dimensions of the other flaps.

In the embodiment of FIG. 2, the front outer panel 32 and its associated end panels 32A and 32B have the transverse tear strip 24 extending integrally across the panels. The design and structure of the tear strip 24 and its operation in effective sealing and convenient tearing-open of a carton of the type disclosed herein is fairly conventional and, accordingly, not described in detail herein. It suffices to state that the tear strip 24 is substantially in the form of a pair of transverse parallel lines having a predefined depth of cut (at least 50 percent) defined on to the outer side of the front outer panel 32 and the associated end panels 32A-B and includes a reinforcing tape (not shown) attached to the inner side of the tear strip to prevent the strip from breaking apart as a result of the strip being removed from the carton 10 during the unsealing operation.

In accordance with the system of the present invention, the front inner panel 40 is provided with a overhanging portion or bottom flap 50 which is connected to the lower transverse edge of the panel 40 by means of a line of weakness 42 which is akin to the earlier-described lines of weakness used for linking the five main panels together. It should be noted that the line of weakness 42 linking the flap 50 to the front inner panel 40 is creased sufficiently deep so as to permit bending or hingedly rotating the flap 50 downwardly and inwardly in order to be adhered, by means of an appropriate glue or like adhering means, to the inside surface of the panel 40, i.e., the surface of the panel 40 which is hidden from view in FIG. 2.

Also, in accordance with the present invention, the front surface of the inner panel 40 has a die-cut portion 52 defined thereupon which includes a proximal flap 54 defined about the bottom transverse edge of the front panel 40 by the same line of weakness 42 which links the bottom flap 50 to the front inner panel 40. In addition, the die-cut portion 52 includes a distal flap or island 56 which is linked to the leading transverse edge of the flap 54 and the surrounding sections of the panel 40 by means of weakening "nicks", whereby the distal island section 56 may easily be separated from both the surrounding portion of the front inner panel 40 and the proximal flap 54.

In particular, the die-cut portion 52, including the proximal flap 54 and the distal island 56, is designed to be such that the island 56 may be adhered in a fixed manner to the inside surface of the front outer panel 32 above the tear-strip 24 generally in the position indicated in dashed lines by the numeral 56'. The arrangement is such that when the recloseable carton of FIG. 1 is formed using the carton blank shown in FIG. 2 and the carton 10 is initially opened by tearing away the tear-strip 24 and upwardly raising the lid 28 thereof, the island 56 on the cut-out portion 52 breaks free of its restricting nicks and remains attached to the lid 28 about the inner surface of the front outer panel 32 at position 56'.

A key advantage with respect to the above-described flap arrangement using the die-cut portion 52 is that when the carton formed from the blank 30 is opened by raising the lid 28, the proximal flap 54 is also rotated outwardly and upwardly. Subsequently, when the carton is closed by replacing the lid to its initial closed position, the island 56 depresses the proximal flap 54 in a downward direction. More importantly, when the lid is closed down to such an extent that the island 56 moves down beyond the extension of the proximal flap 54, the island 56 snaps into a locked position and is restrained from upward movement by the confining action of the proximal flap 54 exerted upon the opposing transverse edge of the island 56.

As a result, the reclosed lid can only be opened by the exertion of a direct force sufficient to snap the island 56 back out of engagement with the proximal flap 54 by virtue of the upward and outward rotation thereof due to the opening of the lid. It will, of course, be recognized that the above-described "snap" action undergone by the island 56 relative to the proximal flap 54 as the lid 28 of the carton 10 is reclosed provides positive tactile as well as audible feedback indicative of effective reclosing and, more importantly, locking of the lid 28 relative to the base section 26 of the carton 10.

It should be noted that the manner in which the carton 10 shown in FIG. 1 is assembled from the paper board blank 30 is fairly conventional except for the above-described manner according to which the bottom flap 50 and the die-cut portion 52 (including the proximal flap 54 and the island 56) is folded and fixedly adhered to the corresponding portions of the blank panels. The overall operations involved in assembling the blank 30 into the carton 10 are well-known to those skilled in the art of paper board packaging containers and is, accordingly, not described in detail herein.

It is sufficient to state herein that the blank 30 is initially folded and glued to form an open-sided generally rectangular, four-sided container by appropriately folding the five main panels 32, 34, 36, 38 and 40 about the corresponding score lines or lines of weakness 42. The recloseable carton 10 of FIG. 1 is basically defined as an enclosure formed by the various panels and end flaps which define the carton blank 30. In particular, the bottom flap 50 is first folded to the extent of 180° about the line of weakness 42 and glued or otherwise adhered so that it lies permanently against the inner side of the front inner panel 40.

Subsequently, the carton 30 is formed into a sleeve (not shown) by successively folding each of the five main panels about the transverse lines of weakness 42 which link adjoining panels by the extent of 90° so that the front outer panel 32 is effectively positioned with its inner surface (the rear or hidden surface with respect to the top view shown in FIG. 2) against the outer surface (the front or visible surface with respect to the top view of FIG. 2) of the front inner panel 40. At this point, the external surface of the island portion 56 which contacts the inner surface of the front outer panel 32 is glued or otherwise fixedly adhered thereto. It is significant that the proximal flap 54 is not affixed to the corresponding inner surface of the front outer panel 32 but, instead, remains in contact therewith by virtue of being linked to the island portion 56 through the connection using the weak nicks described above.

The open-sided sleeve formed as described above is then completed into the form of the carton 10 by appropriately folding in the outwardly extending end flaps and gluing together correspondingly opposed sections thereof. It will be understood by those skilled in the art that this assembly is preferably performed in two stages: first, closing and sealing one side of the box, and next filling the box with the requisite contents prior to closing the remaining side of the box to yield a closed and entirely sealed carton as disclosed in FIG. 1.

In its closed form, the carton 10 is a substantially parallelopiped enclosure formed by opposing top and bottom walls 12, 14 which are respectively defined by the top and bottom panels 34, 38, opposing front and back walls 16 and 18 respectively defined by the front outer panel 32 (in conjunction with the front inner panel 40) and the back panel 36, and opposing side walls 20, 22 respectively defined by (i) the combination of opposingly folded and glued flaps 36A, 38A, 32A (in conjunction with the inner flap 40A) and 34A, and (ii) the flaps 36B, 38B, 32B (in conjunction with the inner flap 40B) and 34B.

Figure 4:
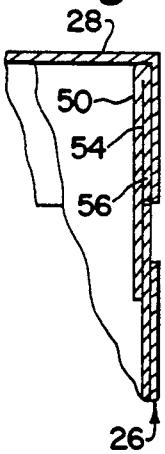
FIG. 4 is a segmented cross-sectional view taken along line 4—4 in FIG. 1 and illustrating the positive locking arrangement according to the system of the present invention.
Figure 5:
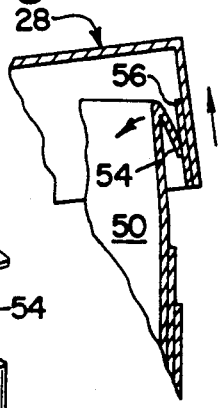
FIG. 5 is a similar segmented cross-sectional view of the positive locking arrangement showing the carton in a partially open condition.
Figure 3:
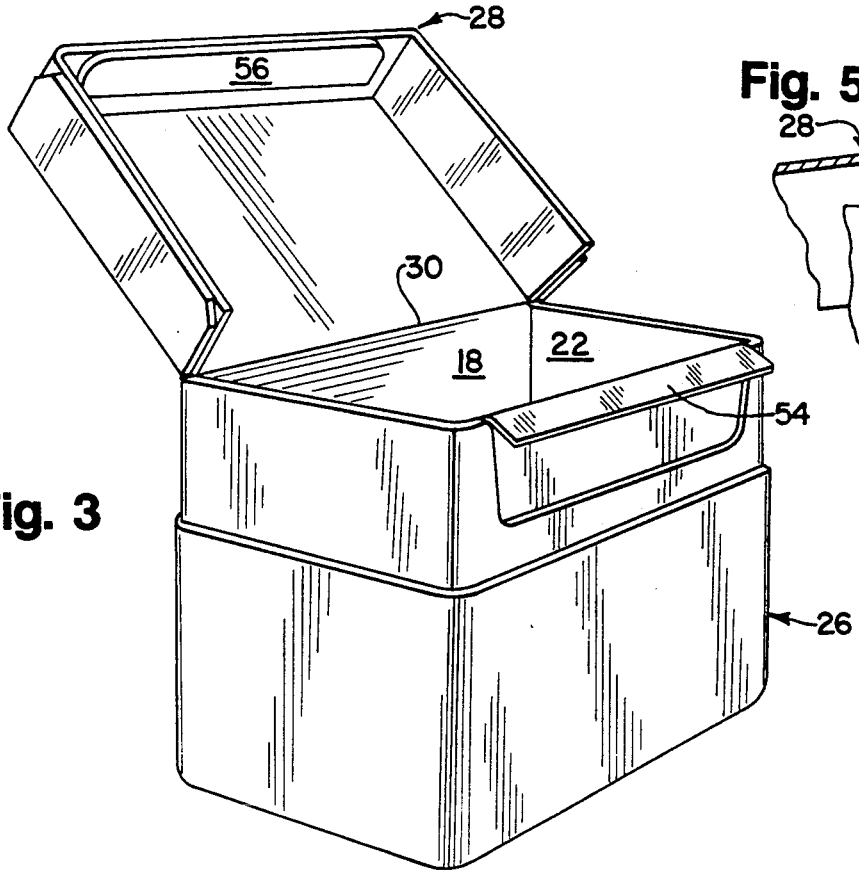
FIG. 3 is a perspective view of the recloseable carton of FIG. 1, as shown in its open condition with the lid raised upwardly to open the carton.

Referring now in particular to FIGS. 3, 4 and 5, there are shown illustrations which facilitate an understanding of the manner in which the positive recloseable locking arrangement functions in accordance with the system of the present invention. As particularly shown in the segmented cross-sectional view of FIG. 4, when the carton is in its sealed condition, the island 56 remains attached to the proximal flap 54 by virtue of the weak nicks through which the two elements are linked. In addition, the island portion 56 is permanently adhered to the corresponding inner surface of the lid 28. At the same time, both the island 56 and the proximal flap 54 also remain in contact with the folded over bottom flap 50 of the front inner panel 40.

When the tear strip 24 has been torn away and the box is opened by pushing the lid 28 in an upwardly direction (as indicated by the large arrow in the segmented cross-sectional of FIG. 5) the upper transverse edge of the island 56 pushes against the corresponding opposing transverse edge of the proximal flap 54. When the upward force exerted upon the lid 28 sufficiently forces the proximal flap 54 as well as a portion of the bottom flap 50 to "give" in the general direction of the small arrow (see FIG. 5), the island 56 clears the restriction presented thereto by the proximal flap 54 and the lid 28 becomes free to be opened. It should be noted that the upward movement of the lid 28 and island 56 initially causes the proximal flap 54 to be hingedly rotated in a upward direction until the upward movement, in combination with the "give" of the flap 54 and flap portion 50, allows the island 56 to clear the flap 54.

When the recloseable carton 10 is reclosed by closing the lid back to its original position, a similar interaction between the proximal flap 54 and the island 56 takes place. More specifically, downward movement of the lid 28 causes the island 56 attached thereto to move against proximal flap 54. As the downward force is continued to be exerted, the island 56 causes the flap 54 to be hingedly rotated in a downward direction while, at the same time, causing the flap 54 and the bottom portion 50 to again "give" until the island 56 completely bypasses the flap 54 and snaps into a locked position with contact between opposing transverse edges of the island 56 and the flap 54. It is this snap/locking action which produces the above-described positive tactile and audible feedback when the lid 28 has been effectively locked.

A significant advantage with the above-described structural design for the positive closure arrangement is that the interlocking elements, i.e., the proximal flap 54 and the distal island 56, are both defined on the front inner panel of the blank which eventually defines the front inner wall of the carton 10. In particular, this design prevents any possibility of the elements being separated from each other or, more importantly, from the carton blank, as a result of any step involved in the assembly process.

The design is also advantageous in that it avoids unnecessary board build-up resulting from folding over of panel sections in order to define the interlocking elements. More specifically, the interlocking action of these elements, as described above with respect to FIGS. 4–6, is realized with minimal board build-up particularly in the "sandwiched" layer portions (see, for instance, FIGS. 4–5) where the overlapping panel sections are adjacently positioned to define the container walls. As a result, the carton panel cuts necessary for proper assembly can be made relatively straight (as opposed to being tapered) so that the resulting assembled carton has a substantially "square" configuration.

I claim:

1. In a recloseable carton having a lid hingedly attached to a base section, said carton defined by opposing top and bottom, walls, opposing front and back walls, and opposing end walls formed from corresponding panels and flaps defined on a unitary continuous carton blank, the outer walls of said side walls and front wall being provided with horizontal tear-strip sections which define an integral and continuous tear strip adapted to open up the carton from a sealed form, said walls and carton panels having inner and outer surfaces, the improvement comprising:

a positive locking arrangement realized by a die-cut portion defined on the inner surface of said panel corresponding to said front wall, said die-cut portion including a proximal flap and an island portion disposed in forcibly displaceable mutual engagement, whereby (i) opening said carton lid exerts a force which disengages said mutual engagement between said proximal flap and said island portion, and (ii) reclosing of said lid leads to snap reengagement of said flap and said island portion accompanied by positive tactile and audible feedback.

2. The improved recloseable carton according to claim 1 wherein said die-cut portion, including said proximal flap and said island portion, is defined on said inner surface of said front wall, and said carton is assembled in such a way that said island portion is fixedly attached to the inner surface of said carton lid and at the same time separatably attached to said proximal flap, whereby opening of said lid separates said island portion from said proximal flap while retaining said flap on the front wall of said carton base.

3. The improved recloseable carton according to claim 2 wherein said proximal flap and said island portion are separatably linked to each other about opposing proximal transverse edges thereof, the distal transverse edges of said island being separatably attached to said inner surface of said front wall panel, whereby opening of said carton lid causes said island portion to be separated from said flap and said front wall surface and be retained on said inner surface of said carton lid.

4. The improved recloseable carton according to claim 3 wherein opening of said carton lid causes said opposing transverse edge of said island portion to push against said opposing transverse edge of said flap until said engagement therebetween is released and said island portion "clears" said flap by relative inward movement of said flap and said front panel surface to which it is attached.

5. The improved recloseable carton according to claim 3 wherein reclosing of said carton lid causes reengagement between said opposed transverse edges of said island and said flap by interaction between said flap and said island portion whereby said flap and said front panel surface to which it is attached undergo relative inward movement until said island "clears" said flap and realizes snap engagement between said opposed transverse edges accompanied by positive tactile and audible feedback.

* * * * *